US010119747B2

(12) United States Patent
You et al.

(10) Patent No.: US 10,119,747 B2
(45) Date of Patent: Nov. 6, 2018

(54) REFRIGERATOR INCLUDING A DOOR HAVING A STORAGE CHAMBER

(71) Applicant: LG ELECTRONICS INC., Seoul (KR)

(72) Inventors: Myung Dong You, Seoul (KR); Hyungki Kim, Seoul (KR); Junyi Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 366 days.

(21) Appl. No.: 14/457,721

(22) Filed: Aug. 12, 2014

(65) Prior Publication Data

US 2015/0040604 A1 Feb. 12, 2015

(30) Foreign Application Priority Data

Aug. 12, 2013 (KR) ..... 10-2013-0095191

(51) Int. Cl.
*F25D 23/04* (2006.01)
*F25D 23/02* (2006.01)
(Continued)

(52) U.S. Cl.
CPC ..... *F25D 23/04* (2013.01); *F25D 23/025* (2013.01); *F25D 23/12* (2013.01); *F25D 31/007* (2013.01); *F25D 2331/805* (2013.01)

(58) Field of Classification Search
CPC .... F25D 23/04; F25D 2331/805; F25D 23/12; F25D 23/025
See application file for complete search history.

(56) References Cited

U.S. PATENT DOCUMENTS 4,951,652 A 8/1990 Ferrario et al.
5,100,213 A * 3/1992 Vandarakis ..... E05D 13/04 312/292
(Continued)

FOREIGN PATENT DOCUMENTS

DE 10 2007 060 830 A1 6/2009
EP 2 131 123 A2 12/2009
(Continued)

OTHER PUBLICATIONS

European Search Report dated Apr. 30, 2015 issued in Application No. 14180499.7.
(Continued)

*Primary Examiner* — Len Tran
*Assistant Examiner* — Paul Alvare
(74) *Attorney, Agent, or Firm* — Ked & Associates, LLP

(57) ABSTRACT

A refrigerator includes a freezing compartment and a refrigerating compartment. A refrigerating compartment door opens and closes the access to the refrigerating compartment. A dispenser is disposed on a front surface of the refrigerating compartment door, and the dispenser has a cavity to dispense at least one of water and ice. An opening is defined in the front surface of the refrigerating compartment door, and the opening is disposed below the cavity. An accommodation chamber is defined in the refrigerating compartment door to communicate with the opening, and the accommodation chamber has a bottom surface inclined downward toward the opening to accommodate a plurality of beverage containers. An auxiliary door is opened and closed to allow access to the opening. An insertion hole, through which the beverage container is inserted, is provided in a rear side of the accommodation chamber, and a cover allows access to the insertion hole.

15 Claims, 8 Drawing Sheets

(51) Int. Cl.

| | |
|---|---|
| *F25D 23/12* | (2006.01) |
| *F25D 31/00* | (2006.01) |

(56) References Cited

U.S. PATENT DOCUMENTS

| | | | | |
|---|---|---|---|---|
| 2003/0097314 | A1 | 5/2003 | Crisp, III et al. | |
| 2004/0004421 | A1* | 1/2004 | Han | F25D 23/04 312/404 |
| 2005/0067929 | A1* | 3/2005 | Gilman | F25D 23/04 312/405.1 |
| 2006/0150661 | A1* | 7/2006 | Kim | F25D 23/04 62/407 |
| 2010/0018989 | A1* | 1/2010 | Kraemer | F25D 23/025 221/199 |
| 2010/0043479 | A1* | 2/2010 | Kim | F25D 23/04 62/389 |
| 2010/0071401 | A1* | 3/2010 | Jang | F25D 23/126 62/391 |
| 2010/0126185 | A1* | 5/2010 | Cho | F25C 5/005 62/3.63 |
| 2010/0259147 | A1* | 10/2010 | Koo | F25D 23/02 312/405 |
| 2010/0281908 | A1* | 11/2010 | Kim | F25C 5/005 62/344 |
| 2011/0072846 | A1* | 3/2011 | Engel | E05F 5/00 62/449 |
| 2012/0062080 | A1* | 3/2012 | Maslen | A47F 3/0434 312/116 |
| 2012/0181304 | A1* | 7/2012 | Kim | F25C 5/005 222/182 |
| 2014/0285082 | A1* | 9/2014 | Choi | F25D 23/028 312/404 |

FOREIGN PATENT DOCUMENTS

| | | | | | |
|---|---|---|---|---|---|
| EP | 2 431 693 | | | 3/2012 | |
| JP | 2000065458 | A | * | 3/2000 | F25D 23/04 |
| KR | 20040105176 | A | * | 12/2004 | F25D 25/027 |
| KR | 20040105177 | A | * | 12/2004 | |
| KR | 10-2005-0051324 | | | 6/2005 | |
| KR | 20070065750 | A | * | 6/2007 | B65D 25/04 |
| KR | 10-2008-0055529 | A | | 6/2008 | |
| KR | 10-2008-0076115 | A | | 8/2008 | |
| KR | 10-2009-0051801 | A | | 5/2009 | |
| KR | 10-2011-0068416 | | | 6/2011 | |
| KR | 10-2011-0075925 | A | | 7/2011 | |
| WO | WO 2009/093801 | A1 | | 7/2009 | |
| WO | WO 2011/003161 | A2 | | 1/2011 | |

OTHER PUBLICATIONS

European Office Action dated Jan. 29, 2016 issued in Application No. 14180499.7.

European Office Action dated Sep. 6, 2016 issued in Application No. 14180499.7.

* cited by examiner

REFRIGERATOR INCLUDING A DOOR HAVING A STORAGE CHAMBER

CROSS-REFERENCE TO RELATED APPLICATION(S)

This application claims priority under 35 U.S.C. § 119 to Korean Patent Application No. 10-2013-0095191 filed on Aug. 12, 2013, whose entire disclosure is hereby incorporated by reference.

BACKGROUND

1. Field

The present disclosure relates to a refrigerator.

2. Background

In general, refrigerators are home appliances for storing foods at a low temperature in an inner storage space covered by a door. A bottle accommodation unit of a refrigerator is disclosed in Korean Patent Publication No. 2004-0049617. The bottle accommodation unit according to the related art is disposed on an inner surface of a door. Therefore, since it is not possible to take bottles in or out before the door is opened, an inconvenience is caused for the user. In addition, cool air in a storage compartment is leaked to the outside while the door is opened.

A tilting-type home bar is disclosed in Korean Patent Publication No. 2013-0005423. In case of the refrigerator having the tilting-type home bar, a user may open the tilting-type home bar to take bottles or cans (hereinafter, referred to as a "beverage container") in or out without opening the door. Since the home bar in which the beverage container is accommodated is rotated, the user may put much force into the rotation of the home bar, and also it may be difficult to easily check the inside of the home bar from the outside.

BRIEF DESCRIPTION OF THE DRAWINGS

The embodiments will be described in detail with reference to the following drawings in which like reference numerals refer to like elements wherein.

DETAILED DESCRIPTION

Figure 1:
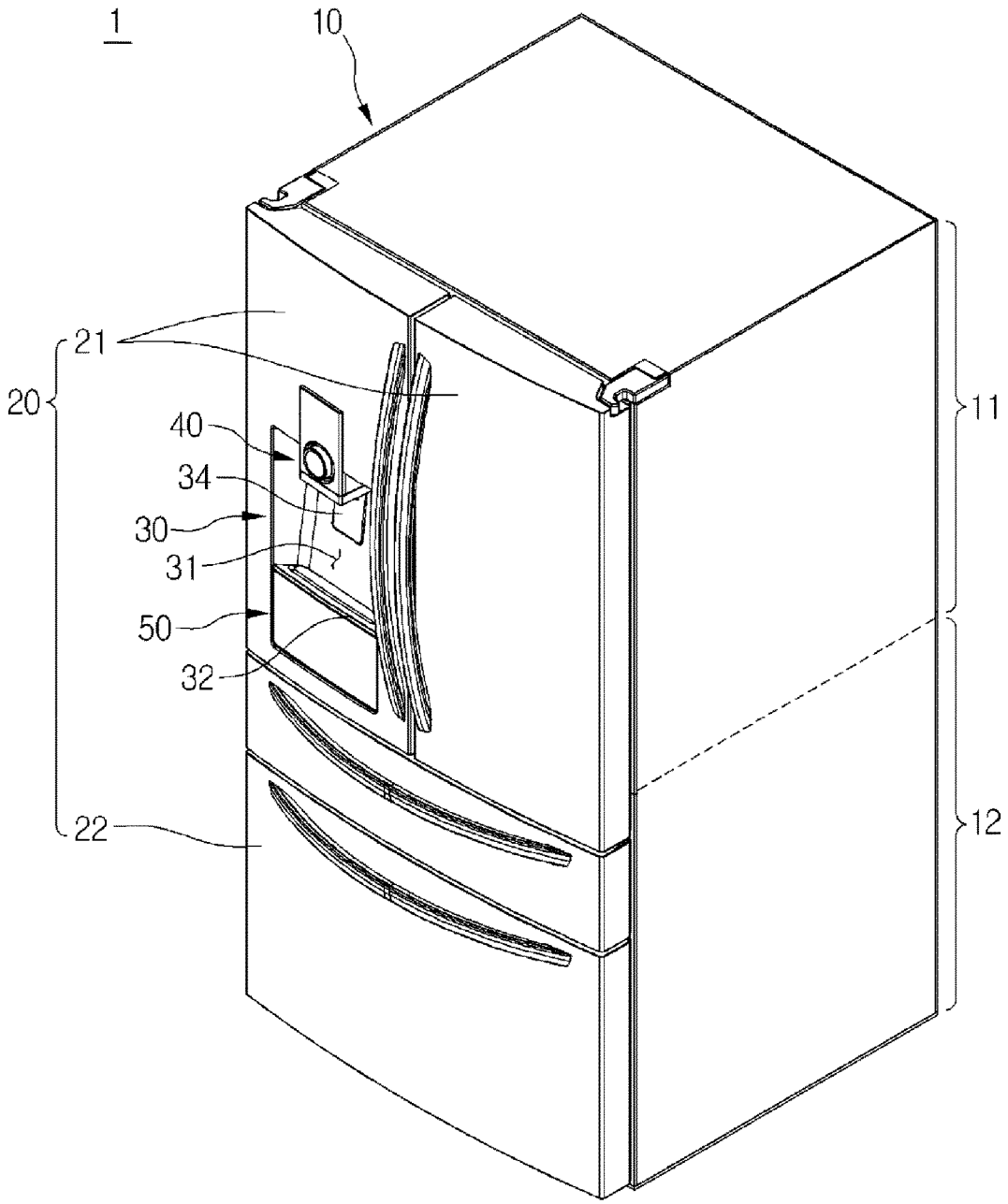
FIG. 1 is a perspective view of the refrigerator according to an embodiment.

FIG. 1 is a perspective view of the refrigerator according to an embodiment. Referring to FIG. 1, a refrigerator 1 according to the current embodiment may include a main body 10 having a storage compartment therein and a refrigerator door 20 rotatably mounted on the main body 10. The inside of the main body 10 is vertically partitioned to define a refrigerating compartment 11 at an upper side and a freezing compartment 12 at a lower side.

A refrigerating compartment door 21 and a freezing compartment door 22 for respectively opening/closing the refrigerating compartment 11 and the freezing compartment 12 may be coupled/mounted on the main body 10. Here, the refrigerating compartment door 21 may be provided in a pair of left and right doors which is capable of separately opening and closing the refrigerating compartment 11. That is, the main body 10 may include a plurality of refrigerating compartment doors 21. The freezing compartment door 22 may be a drawer type door. The freezing compartment door 22 may be slidably inserted into or withdrawn from the main body 10 in a forward/backward direction. The main body 10 may include one freezing compartment door 22 or a plurality of freezing compartment doors 22. Although the plurality of freezing compartment doors 22 are disposed in the main body 10 in a vertical direction in FIG. 1, the current embodiment is not limited thereto.

A first dispenser 30 that is capable of dispensing at least one of water or ice may be disposed in one side of one of the plurality of refrigerating compartment doors 21. The first dispenser 30 may be manipulated from the outside of the refrigerator to dispense water and/or ice. The refrigerator 1 may be provided with a device for supplying the purified water and/or ice to the first dispenser 30. The descriptions with respect to the device will be omitted because its technology in the refrigerator is apparent to one of ordinary skill in the art.

The first dispenser 30 may include a cavity 31 that is recessed inward. A dispensing lever 34 may be disposed in the cavity 31 to determine a dispensing operation of the water and/or ice dispensed through the first dispenser 30. A control unit 40 may be disposed above the cavity 31 to adjust an operation state of the refrigerator 1 and to display operation information of the refrigerator 1.

A tray 32 may be disposed in a lower portion of the cavity 31 so that a container is placed when the water or the ice is dispensed. The tray 32 may be separably disposed or be withdrawably disposed in the refrigerating compartment door 21 so as to throw away remaining water generated after the water or the ice is dispensed.

A second dispenser 50 (or a beverage container dispenser) for taking a beverage container in and out such as a bottle or can may be disposed under the first dispenser 30. The tray 32 may be disposed between the first dispenser 30 and the second dispenser 50. The second dispenser 50 may independently take only the beverage container out of the outside of the refrigerating compartment door 21 or take the beverage container in the second dispenser 50 without opening the refrigerating compartment door 21.

Figure 2:
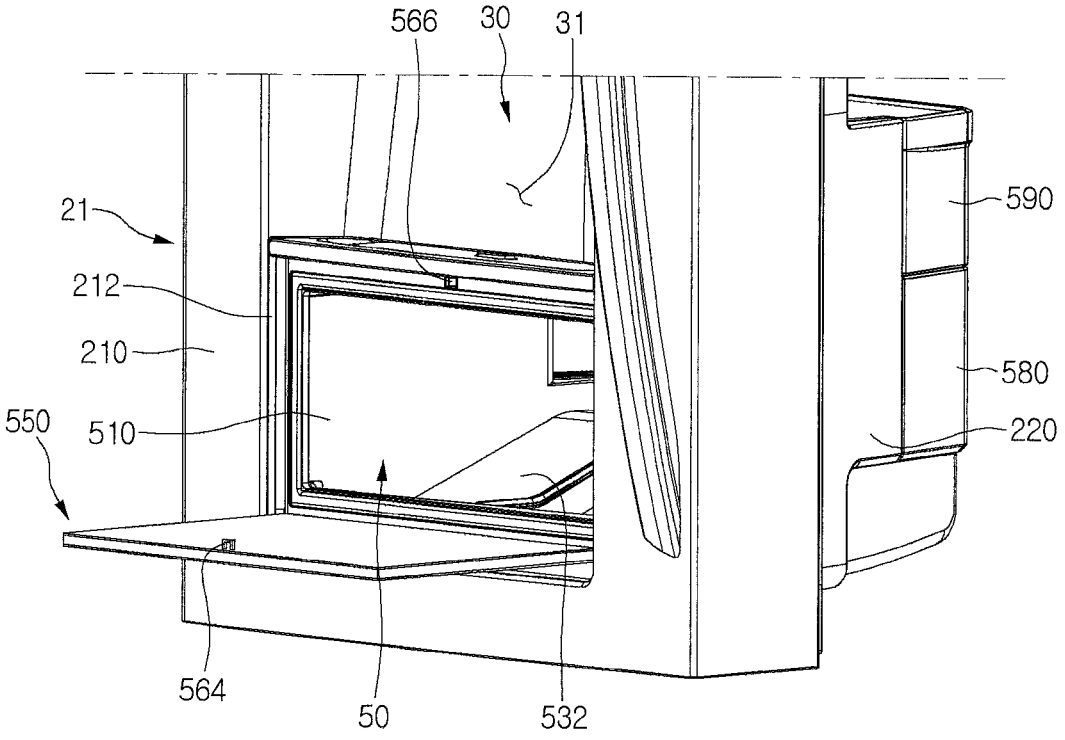
FIG. 2 is a view illustrating a state where an auxiliary door of a second dispenser is opened.
Figure 3:
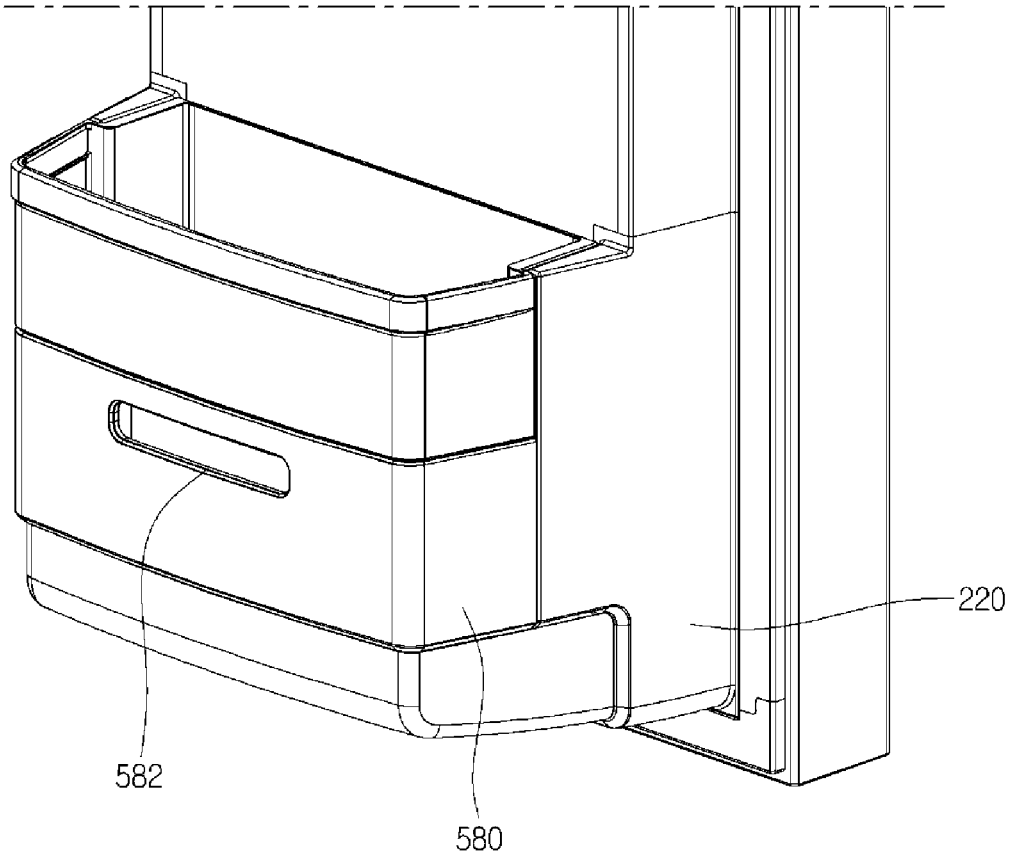
FIG. 3 is a perspective view illustrating a rear surface of a door of the refrigerator according to an embodiment.
Figure 4:
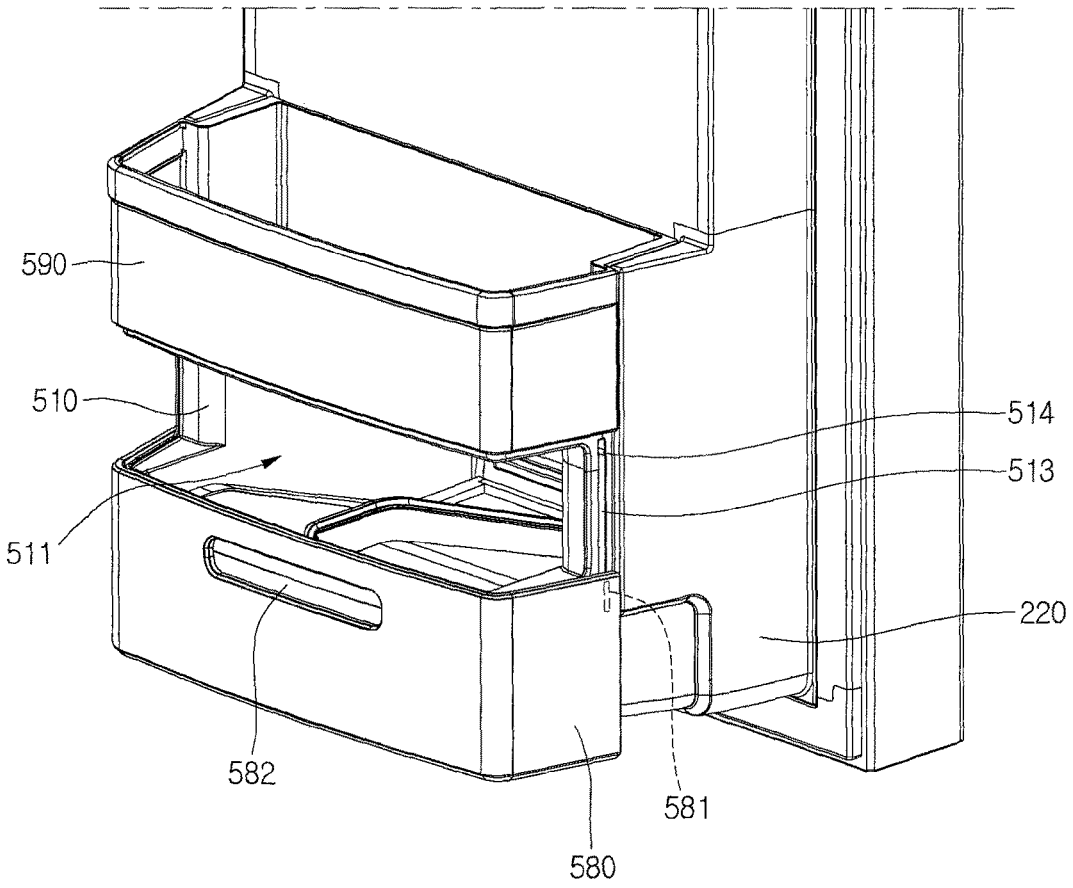
FIG. 4 is a view illustrating a state where a cover of the second dispenser is opened.

FIG. 2 is a view illustrating a state where an auxiliary door of a second dispenser is opened, FIG. 3 is a perspective view illustrating a rear surface of a door of the refrigerator according to an embodiment, and FIG. 4 is a view illustrating a state where a cover of the second dispenser is opened.

Referring to FIGS. 2 to 4, the refrigerating compartment door 21 may include a front panel 210 defining an outer appearance thereof, a door liner 220 connected to the front panel 210, and an insulation material (not shown) disposed between the front panel 210 and the door liner 220.

The second dispenser 50 may be disposed in a space between the front panel 210 and the door liner 220. Of course, a portion of the second dispenser 50 may be exposed to the front panel 210, and the other portion of the second dispenser 50 may be exposed outside the door liner 220 so that it is accessible therethrough by a user.

The second dispenser 50 may include a chamber formation part 510 defined between the front panel 210 and the door liner 220 to define an accommodation chamber in which the beverage container is stored. The insulation material may be disposed in a space between the front panel 210 and the door liner 220 except for a space in which the chamber formation part 510 is defined.

A first opening 212 through which the beverage container is taken in and out may be defined in the front panel 210. A second opening (see reference numeral 222 of FIG. 6) may be defined in the door liner 220.

The second dispenser 50 may include an auxiliary door 550 for opening and closing the first opening 212. The auxiliary door 550 may be rotatably coupled to the refrigerating compartment door 21 by a hinge. The auxiliary door 550 may be a dispenser door in the current embodiment.

The chamber formation part 510 may pass through the second opening 222 of the door liner 220 to protrude from a rear surface of the refrigerating compartment door 21 backward. Thus, the chamber formation part 510 for accommodating the beverage container may increase in volume.

A latch 564 is disposed on the auxiliary door 550. Also, a latch slot 566 to which the latch 564 is coupled may be defined in the refrigerating compartment door 21 or in the chamber formation part 510. Here, the latch 564 may be disposed on an upper end of a rear surface of the auxiliary door 550. The auxiliary door 550 may open and close the first opening 212 while the upper end of the auxiliary door 550 is rotated with respect to the hinge of a lower end of the auxiliary door 550.

The chamber formation part 510 may include a top surface, a bottom surface, and both side surfaces. Thus, the chamber formation part 510 may include an opening 511 into which the beverage container is inserted. The opening 511 may be opened and closed by a cover 580. One or more holes 582 through which the refrigerating compartment 11 communicates with the accommodation chamber in the chamber formation part 510 may be defined in the cover 580. At least one basket 590 may be further disposed above the second dispenser 50 in the rear surface of the refrigerating compartment door 21.

Thus, in a state where the refrigerating compartment door 21 is closed, when the auxiliary door 550 is opened to take the beverage container out of the container chamber, the cover 580 in a closed state (FIG. 3) may minimize discharge of cool air in the refrigerating compartment 11 to the outside through the second dispenser 50 compared to the cover 580 in an open state (FIG. 4).

For example, the cover 580 may be slidably connected to the chamber formation part 510 and movable in a vertical direction. A guide part 513 (a groove or hole) extending in a vertical direction may be defined in the chamber formation part 510. A guide protrusion 581 inserted into the guide part 513 may be disposed on the cover 580. The cover 580 may be vertically slid by the guide protrusion 581 and the guide part 513 to open or close the insertion hole 511.

A hook protrusion 514 may be disposed on the guide part 513, and a hook groove (not shown) into which the hook protrusion 514 is inserted may be defined in the guide protrusion 581 so that the cover 580 maintains the insertion hole 511 in a closed state. The hole 582 may be used by a user to lift or lower the cover 580 in a closed state or open state, respectively. Although a single hole is provided, the number of holes or smaller holes may be used to control the passage of refrigerant to the accommodation/storage chamber. In an alternative embodiment, the hole 582 may be replaced with a slidable panel to control a size of the opening, where the size controls the amount of refrigerant into the accommodation/storage chamber.

Thus, the user may open the auxiliary door 550 to take the beverage container out of or in the accommodation chamber in the state where the refrigerating compartment door 21 is closed. Also, the user may open the cover 580 to take the beverage container out of or in the accommodation chamber in a state where the refrigerating compartment door 21 is opened, and the auxiliary door 550 is closed.

Figure 5:
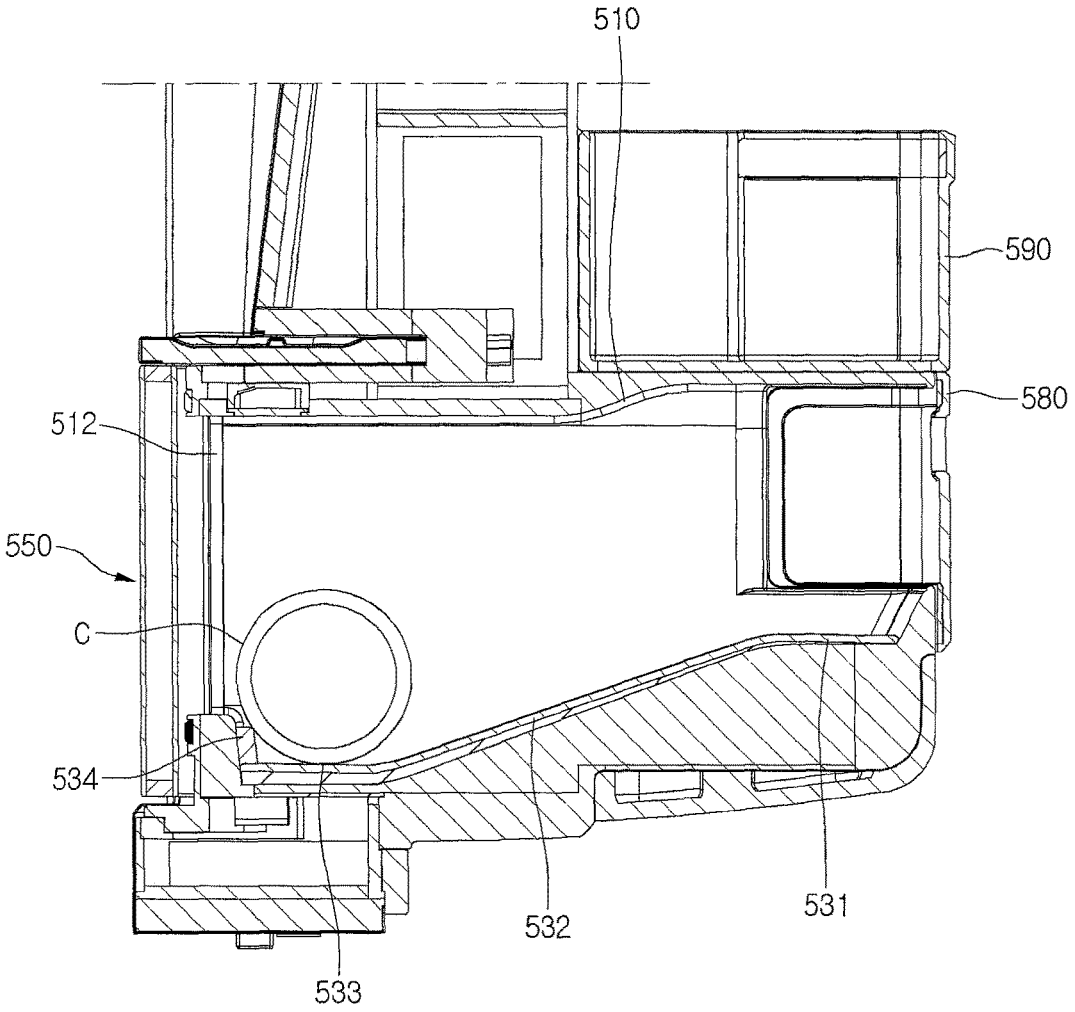
FIG. 5 is a vertical cross-sectional view of the second dispenser according to an embodiment.
Figure 6:
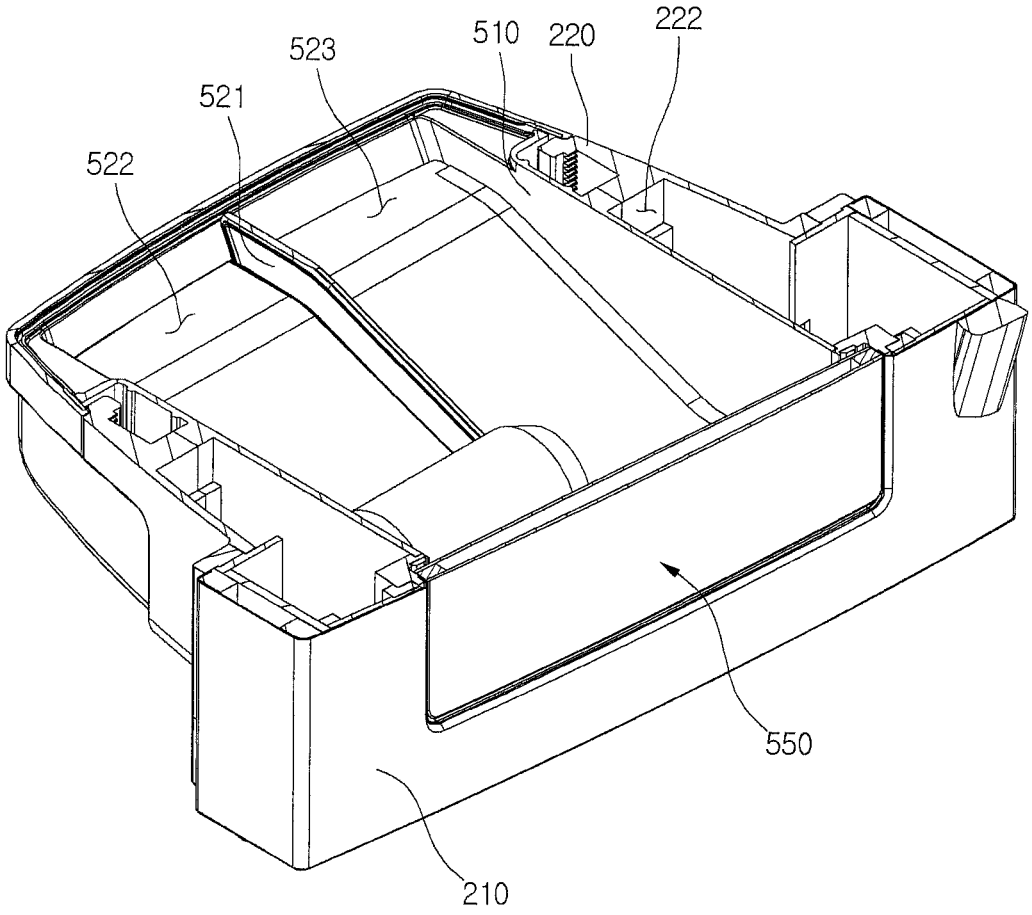
FIG. 6 is a horizontal cross-sectional view of the second dispenser according to an embodiment.

FIG. 5 is a vertical cross-sectional view of the second dispenser according to an embodiment, and FIG. 6 is a horizontal cross-sectional view of the second dispenser according to an embodiment.

Referring to FIGS. 4 to 6, the chamber formation part 510 may further include a discharge hole 512 (or "an opening"). The auxiliary door 550 opens and closes the first opening 212 to open and close the discharge hole 512.

Usually, the beverage container is inserted into the insertion hole 511, but the user takes the beverage container out in a state where the user's hand is inserted into the chamber formation part 510 through the discharge hole 512. Hence, the discharge hole 512 may have an area greater than that of the insertion hole 511.

A bottom surface of the chamber formation part 510 may include a first surface 531 disposed adjacent to the cover 580, a second surface 532 gradually inclined downward from the first surface 531 to the auxiliary door 550, and a third surface 533 horizontally extending from the second surface 532. Alternatively, the bottom surface of the chamber formation part 510 may include only the inclined surface or may include only the second and third surfaces 532 and 533. In the current embodiment, the second surface 532 may be an inclined surface, and the third surface 533 may be a stopping surface. The second surface 532 guides the beverage container inserted through the insertion hole 511 to move toward the discharge hole 512.

A stopper 534 for supporting the beverage container may be disposed on the bottom surface of the chamber formation part 510 so as to prevent a beverage container C from falling to the outside due to its self-weight in the state where the auxiliary door 550 is opened. The stopper 534 may be disposed adjacent to the discharge hole 512 to protrude upward from the bottom surface of the chamber formation part 510. Alternatively, the stopper 534 may not be provided in the chamber formation part 510, but be coupled to or disposed adjacent to the chamber formation part 510 as a separate member. Alternatively, the stopper 534 may be provided as one portion of the front panel or be coupled to the front panel.

The chamber formation part 510 may include a partition unit or plate 521 for partitioning an inner space of the chamber formation part 510 in left and right portions. A first accommodation chamber 522 and a second accommodation chamber 523 may be defined in the chamber formation part 510 by the partition unit 521. Here, the partition unit 521 may be movably disposed on the chamber formation part 510 in a left/right direction in FIG. 6 so that the first accommodation chamber 522 and the second accommodation chamber 523 vary in area.

Figure 7:
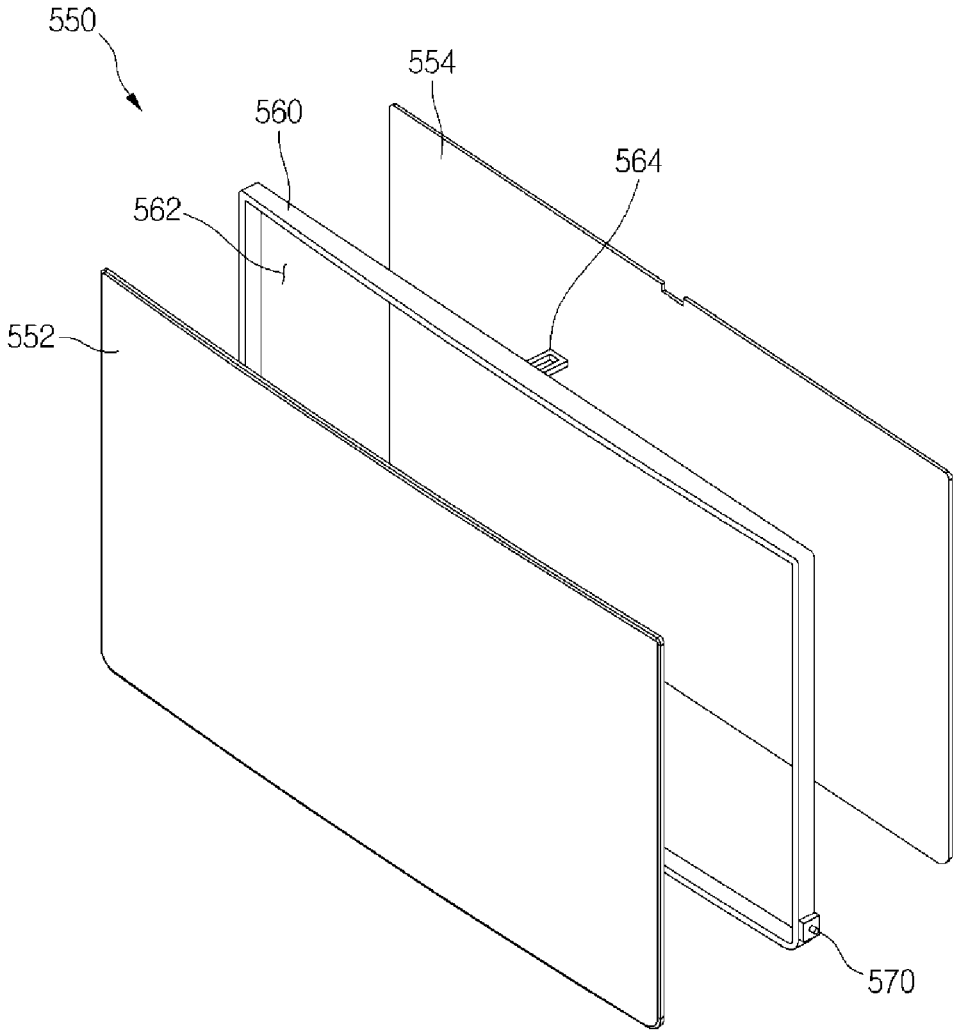
FIG. 7 is an exploded perspective view of an auxiliary door according to an embodiment.
Figure 8:
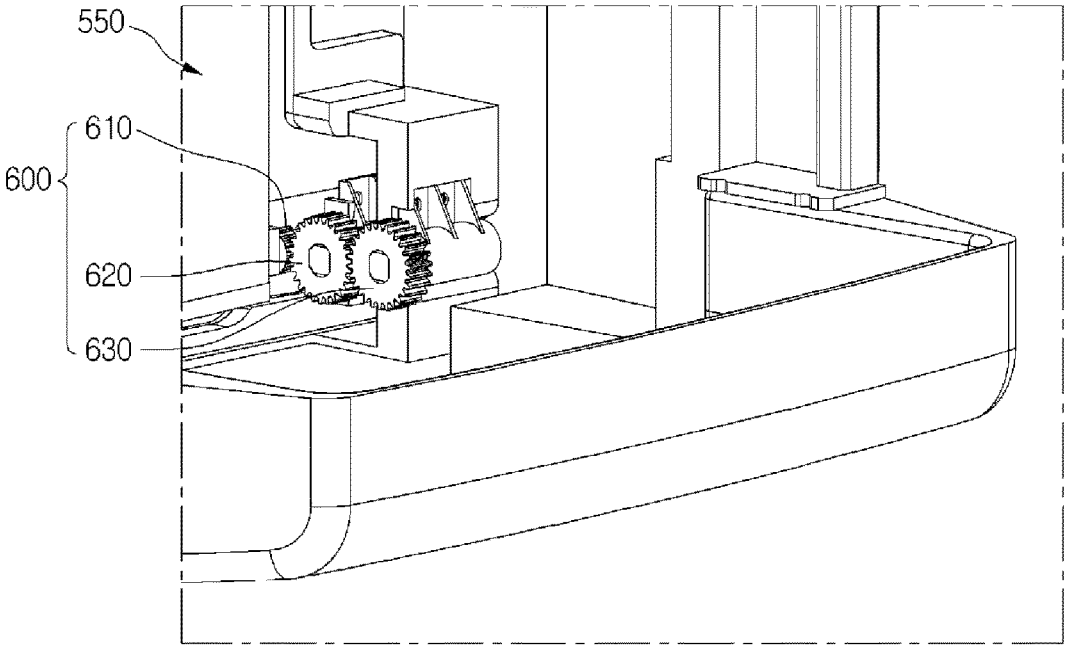
FIG. 8 is a view of a damping mechanism for reducing a rotation rate of the auxiliary door according to an embodiment.

FIG. 7 is an exploded perspective view of an auxiliary door according to an embodiment, and FIG. 8 is a view of a damping mechanism for reducing a rotation rate of the auxiliary door according to an embodiment. The auxiliary door 550 may include a first panel 552 formed of a transparent or translucent material, a second panel 554 spaced apart from the first panel 552 in a forward/backward direction and formed of a transparent or translucent material, and a frame 560 connecting the first panel 552 to the second panel 554.

The first panel 552 and the second panel 554 may be formed of glass or an acryl material. The frame 560 may have a rectangular frame shape having an opening 562. Here, a front surface of the frame 560 may contact a rear surface of the first panel 552, and a rear surface of the frame 560 may contact a front surface of the second panel 554. Also, the latch 564 may be disposed on an upper end of the frame 560.

The auxiliary door 550 may be vacuum-insulated in the current embodiment. That is, spaces (substantially the opening 562) defined by the first panel 552, the second panel 554, and the frame 560 are in a vacuum state. The external air may be insulated from air within the chamber formation part to maintain the chamber formation part at a temperature that is substantially the same as that in the refrigerating compartment.

Because the first and second panels 552 and 554 are formed of transparent or translucent material (user may see the inside of the chamber formation part when the auxiliary door is closed), the user may easily check whether the beverage container C is stored in the chamber formation part without opening the auxiliary door 550.

A hinge 570 may be disposed on a side surface of the frame 560. A damping mechanism 600 may be connected to the hinge 570. The damping mechanism 600 may be connected to the hinge 570 outside of the chamber formation part 510.

The damping mechanism 600 may include a hinge gear 610 connected to the hinge 570 and one or more damping gears 620 and 630 engaged with the hinge gear 610. For example, the damping gears 620 and 630 may include a first damping gear 620 engaged with the hinge gear 610 and a second damping gear 630 engaged with the first damping gear 620. Alternatively, the first and second damping gears 620 and 630 may be directly engaged with the hinge gear 610.

According to the current embodiment, since the hinge 570 of the auxiliary door 550 is connected to the damping mechanism 600, it may prevent the auxiliary door 550 from being suddenly rotated downward.

Although the refrigerator in which the refrigerating compartment is disposed above the freezing compartment is described in the current embodiment, the embodiment is not limited thereto. For example, the embodiment may be applied to a refrigerator in which a freezing compartment and a refrigerating compartment are disposed in a left/right direction. In this case, the first dispenser 30 and the second dispenser 50 may be disposed in the door for opening and closing the refrigerating compartment.

In the current embodiment, the refrigerating compartment door 21 may be called a first door, and the auxiliary door 550 may be called a second door. Also, the cover may be called a third door.

Also, although the first and second dispensers are disposed in the refrigerating compartment door in the current embodiment, the embodiment is not limited thereto. For example, the first and second dispensers may be disposed in the freezing compartment door, and the first and second dispensers may be disposed in doors different from each other.

In one embodiment, a refrigerator includes: a main body having a freezing compartment and a refrigerating compartment disposed above the freezing compartment; a refrigerating compartment door to open and close the refrigerating compartment; a dispenser disposed on a front surface of the refrigerating compartment door, the dispenser having a cavity to dispense at least one of water or ice; an opening defined on the front surface of the refrigerating compartment door, the opening being disposed below the cavity; an accommodation chamber defined in the refrigerating compartment door to communicate with the opening, the accommodation chamber having a bottom surface inclined downward toward the opening to accommodate a plurality of beverage containers; an auxiliary door to open and close the opening; an insertion hole, through which the beverage container is inserted, in a rear side of the accommodation chamber; and a cover to open and close the insertion hole.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body having a freezing compartment and a refrigerating compartment disposed above the freezing compartment;

a refrigerating compartment door to open and close the refrigerating compartment;

a dispenser that is capable of dispensing ice and including a cavity recessed inwardly from a front surface of the refrigerating compartment door;

a dispensing lever disposed in the cavity to determine a dispensing operation of the ice;

an opening defined on a front surface of the refrigerating compartment door and disposed vertically below the cavity recessed inwardly from the front surface of the refrigerating compartment door;

a chamber formation part fixed to the refrigerating compartment door to define a storage chamber to store a plurality of beverage containers, the storage chamber being in communication with the opening and having a bottom surface inclined downward toward the opening, the storage chamber being disposed vertically below the cavity of the dispenser such that the storage chamber is arranged to overlap at least a portion of the cavity of the dispenser in a vertical direction;

an auxiliary door configured to open and close the opening;

an insertion hole, through which the beverage container is inserted, in a rear side of the storage chamber, at least a portion of the insertion hole being disposed lower than the dispenser; and a cover slidably connected to the chamber formation part to open and close the insertion hole and movable in a vertical direction, wherein the cover includes a rear wall and a pair of side walls, each of the side walls including a first guide portion and the chamber formation part including a second guide portion that interacts with the first guide portion, wherein the cover is slid downward to open the insertion hole.

2. The refrigerator according to claim 1, wherein the beverage containers are inserted through the insertion hole in a horizontal direction.

3. The refrigerator according to claim 1, wherein at least one portion of the insertion hole faces the opening.

4. The refrigerator according to claim 1, wherein the cover comprises at least one hole to allow the refrigerating compartment to communicate with the storage chamber.

5. The refrigerator according to claim 1, wherein the opening has an area greater than that of the insertion hole.

6. The refrigerator according to claim 1, wherein a stopper is provided in the storage chamber to prevent the stored beverage containers from being discharged through the opening.

7. The refrigerator according to claim 1, wherein the storage chamber is partitioned into a plurality of chambers by at least one movable plate.

8. The refrigerator according to claim 1, wherein a tray is disposed between the dispenser and the opening.

9. The refrigerator according to claim 1, wherein at least one portion of the auxiliary door is transparent or translucent to allow visual inspection of the inside of the storage chamber.

10. The refrigerator according to claim 9, wherein the auxiliary door comprises:

first and second panels spaced apart from each other in a forward/backward direction; and a frame connecting the first panel to the second panel, wherein spaces between the first panel, the second panel, and the frame are in a vacuum state.

11. The refrigerator according to claim 1, wherein a hinge is provided on the auxiliary door, and the hinge is connected to a damping mechanism to reduce a rotation rate of the auxiliary door.

12. The refrigerator according to claim 11, the damping mechanism comprises:

a hinge gear connected to the hinge; and at least one damping gear engaged with the hinge gear.

13. The refrigerator according to claim 1, wherein a latch is disposed on the auxiliary door, and a latch slot to which the latch is coupled is defined in the refrigerating compartment door.

14. The refrigerator according to claim 1, further comprising a basket disposed on a rear surface of the refrigerating compartment door above the insertion hole.

15. The refrigerator according to claim 1, wherein the refrigerating compartment door comprises a front panel to define an outer appearance of the refrigerating compartment door and a door liner connected to the front panel, wherein the chamber formation part passes through the door liner and at least a portion of the chamber formation part is disposed in a space between the front panel and the door liner, and wherein a distance between the opening and the insertion hole is greater than a thickness of the refrigerating compartment door.

* * * * *